United States Patent [19]

Lee

[11] Patent Number: 4,622,742

[45] Date of Patent: Nov. 18, 1986

[54] DISPOSABLE SAFETY STRAIGHT RAZOR

[76] Inventor: Sang D. Lee, 867 Cottonwood Dr., Severana Park, Md. 21146

[21] Appl. No.: 747,247

[22] Filed: Jun. 21, 1985

[51] Int. Cl.[4] ..... B26B 21/06

[52] U.S. Cl. ..... 30/55; 30/85

[58] Field of Search ..... 30/47, 53, 54, 55, 90, 30/286, 295, 77, 51, 151, 85

[56] References Cited

U.S. PATENT DOCUMENTS

| | | | |
|---|---|---|---|
| 311,466 | 2/1885 | Brokhalme | 30/90 |
| 739,371 | 9/1903 | Allen | 30/286 |
| 889,004 | 5/1908 | Hansen | 30/151 |
| 1,405,759 | 2/1922 | Coleman | 30/53 X |
| 1,869,504 | 8/1932 | Priori . | |
| 2,298,944 | 10/1942 | Hyatt | 30/51 X |
| 3,066,413 | 12/1962 | Saavedra . | |
| 3,646,672 | 3/1972 | Braginetz | 30/54 |
| 3,748,736 | 7/1973 | Eisen | 30/151 |
| 4,498,236 | 2/1985 | McIntyre | 30/34.1 |

*Primary Examiner*—Jimmy C. Peters

*Attorney, Agent, or Firm*—Richard J. Rodrick

[57] ABSTRACT

A disposable razor comprises a body having a blade end and a handle end. The blade end includes a razor blade edge protruding from one side thereof. The handle end is adapted to be grasped during use of the razor and is separable from the body. Within the handle end is a groove for protectively covering the razor blade edge after the razor has been used and the handle end separated from the body of the razor.

20 Claims, 6 Drawing Figures

DISPOSABLE SAFETY STRAIGHT RAZOR

BACKGROUND OF THE INVENTION

1. Field of the Invention

The present invention relates to a razor, and more particularly, concerns a disposable safety straight razor wherein the handle portion serves as a gripping member during use and as a protective member after the razor has been used.

2. Description of the Prior Art

Straight razors have been used in barber shops and for professional hair removal purposes for many years. At present, straight razors are not widely used for personal shaving in the home, although straight razors may certainly be used in the home, if so desired.

In their most common usage in professional-type barber shops, straight razors are normally used many times over and over again, until the blade becomes worn or can no longer be properly sharpened. Of course, straight razors in barber shops are not only used many times, but are also used on different customers. It is therefore imperative that the razor be cleaned, as well as sharpened before each use. Maintaining the razor in a clean and sharpened condition for repeated usage, of course, requires cleaning and sharpening materials on the premises of the barber shop. Not only do these cleaning and sharpening materials add expense to the overall operation of the barber shop establishment, but time is also needed to undertake the cleaning and sharpening activities. In the event that the barber fails to take the time to properly clean the razor, an unclean blade which nicks the face of the customer could increase the risk of contamination by the spread of germs, bacteria or the like. This could present a serious problem of infection, particularly with respect to those customers who are prone to being scraped or nicked, or bleeding during the shaving process.

Should the barber fail to sharpen the razor before shaving a customer, either due to neglect or other pressing time constraints, not only will the customer have an unpleasant shave, but once again, the risk of nicking and cutting the customer will increase.

There is also a question of safety with respect to straight razors when they are not being used. For example, and since straight razors for professional or barber purposes are intended for repeated usage, such straight razors may be placed on top of the barber's table or work place with the blade exposed. The exposed blade poses a risk for the barber particularly when he may be reaching for other items on his work table. While presently available straight razors include a shield pivotally attached to the blade, it is many times convenient for the barber to merely place the razor on his table without folding the blade into the attached shield. In such event, the blade continues to remain exposed and poses a risk to the barber or anyone else near the work table. Typical examples of razors which include a pivotally attached shield for the blade are found in U.S. Pat. Nos. 4,498,236; 3,066,413; and 1,869,504.

There is clearly a need for improvements in safety straight razors. In particular, one of those needs is for a disposable safety straight razor which not only may be economically manufactured, but also eliminates the need for repeated cleaning or sharpening, and which provides safety features both prior and after usage of the razor. It is toward such a safety straight razor that the present invention is directed.

SUMMARY OF THE INVENTION

The razor of the present invention comprises a body having a first end and a second end. The first end has a razor blade edge protruding therefrom. The second end is adapted to be grasped during use of the razor and is separable from the body. Means associated with the second end protectively covers the razor blade edge after the razor has been used and the second end separated from the body.

In a preferred embodiment of the present invention, the safety straight razor comprises an elongate body having a handle end for grasping by a user during use, and a blade end at the other end of the body. Included in the blade end is a blade having a sharp edge protruding therefrom for shaving purposes. The handle end includes an elongate groove adapted to fit over the blade after the razor has been used. An area of joinder is provided for joining the handle end and the blade end of the body. This area of joinder is characterized by an area of structural weakness so that the handle end and the blade end are separable. When the handle end of the body is separated therefrom, it serves as a protective cover for the blade by placement of the blade into the groove of the handle end.

In accordance with the principles of the present invention, a safety straight razor is provided which overcomes the deficiencies pointed out above with respect to safety straight razors. The razor of the present invention may be economically and conveniently manufactured so that it may be disposable after one use. By providing a disposable safety straight razor, particularly suitable for barber and professional use, there is no need for cleaning and resharpening as is required in presently available straight razors for professional use. Since the present invention may be disposable, and cleaning and resharpening is not required, significant savings in barber shop materials, as well as time, may be realized. Safety concerns are also addressed by the razor of the present invention. In particular, a shield is provided for covering the exposed edge of the razor prior to use for shaving purposes. After use, a protective cover is provided for the blade so that the risk of injury during subsequent handling is eliminated or minimized. The protective cover for the blade after use of the razor is the handle portion of the razor itself. During use of the razor, the handle portion is grasped by the user to manipulate the razor; after use, the handle portion is separated from the razor by a snapping or breaking action, and the separated handle portion is placed over the exposed razor blade edge for protective purposes. Since the protective cover for the exposed razor blade edge is the separated handle, the present invention eliminates the need to include pivotal attachment features for the cover as is known in the prior art straight razors. Other advantages and features of the present invention will become more apparent upon reading the detailed description which follows.

DETAILED DESCRIPTION

Figure 1:
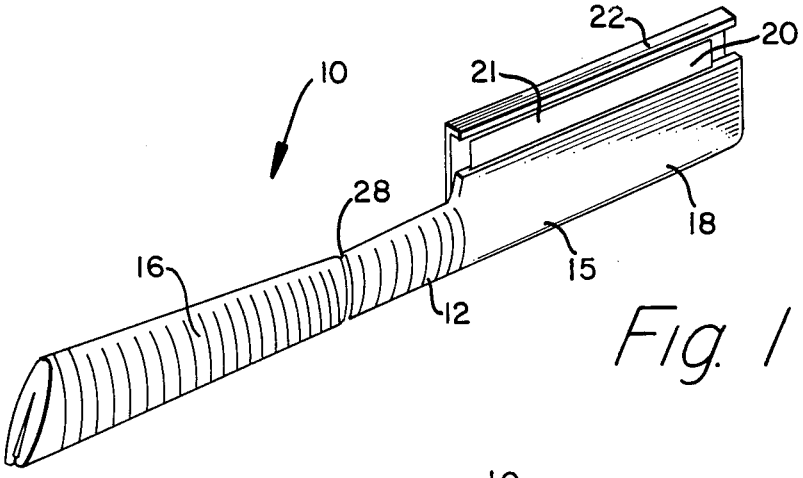
FIG. 1 is a perspective view of the preferred embodiment of the present invention illustrating a disposable safety straight razor.
Figure 2:
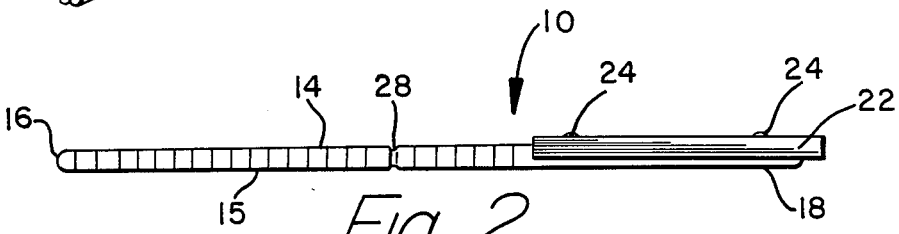
FIG. 2 is a top, plan view of the safety straight razor illustrated in FIG. 1.

While this invention is satisfied by embodiments in many different forms, there is shown in the drawings and will herein be described in detail a preferred embodiment of the invention, with the understanding that the present disclosure is to be considered as exemplary of the principles of the invention and is not intended to limit the invention to the embodiment illustrated. The scope of the invention will be measured by the appended claims and their equivalents.

Turning now to the drawings and FIGS. 1–4 in particular, there is illustrated the preferred embodiment of a safety straight razor 10 of the present invention. It can be seen that razor 10 includes a substantially flat, elongate body 12. Inasmuch as the present invention is intended primarily for barber shop or professional use, the elongate and flat nature of the present razor allows for easy handling, storage and manipulation of the razor. To this end, body 12 is characterized by two opposed substantially planar surfaces 14 and 15 forming the sides of the flat body of the razor.

Body 12 of the razor is further comprised of a handle end 16 and a blade end 18. As the nomenclature indicates, handle end 16 is intended for grasping by a user of the razor during the shaving procedures. Handle end 16 may be contoured to lie comfortably within the hand of the user, and may include a scored surface or the like to eliminate slippage in the hand of the user. Design of the handle end of the razor of the present invention may thus take on many different forms or shapes, consistent with the purpose of the present invention.

Blade end 18 includes a razor blade 20 for shaving purposes. It is preferred that blade 20 be positioned in blade end 18 so that it lies substantially parallel to the flat cross-section of the blade end characterized by substantially planar opposed surfaces 14 and 15. It can be seen in the drawings and FIGS. 1 and 4 in particular, that blade 20 has its sharp edge 21 protruding from one side of blade end 18. While the embodiment being described is directed to a razor having a singular blade edge protruding from one side of the blade end, it is also within the purview of the present invention to include multiple blade edges protruding from either the same side or different sides of the razor. It is also preferred that blade 20 be positioned in blade end 18 so that it is embedded between opposed planar surfaces 14 and 15 as more clearly illustrated in FIG. 4. Moreover, since razor 10 in its entirety is intended to be disposable, it is preferred that blade 20 be irremovably positioned in the blade end of the razor. Along these lines, blade 20 may be permanently molded into the blade end, staked, bonded with adhesives, press fit, or otherwise permanently positioned so that it cannot be readily removed from the razor.

In order to protect blade 20 prior to use of the razor, including its storage and shipment, a shield 22 is provided. It can be seen that shield 22 is preferably a substantially flat protective member which is connected to surface 14 of the razor at blade end 18. The shield extends over protruding sharp edge 21 of the blade. This shield eliminates the risk of someone being injured by the sharp blade edge before use of the razor. While the type of connection of shield 22 to surface 14 is not critical, the shield must be removable from the razor in order to expose blade 20 for shaving purposes. Therefore, shield 22 should be connected to surface 14 so that either its connection to surface 14 may be broken or the shield itself broken, so that the blade may be sufficiently exposed for use. In the embodiment being described, shield 22 may be thermoplastically welded, indicated by spots 24 in the drawings, or other connection means may be utilized consistent with the intent and purpose of the shield as described above. It is appreciated that shield 22 is assembled as part of razor 10 in the manufacture of the razor and remains attached until the razor is ready for use. Shield 22 is disconnectable from blade end 18 by simple manual hand manipulation. Once shield 22 has been removed, it is no longer needed and should be properly discarded.

As illustrated in the drawings, handle end 16 and blade end 18 of the razor are connected to each other by an area of joinder 28. This area of joinder is also intended to be an area of structural weakness so that handle end 16 may be separated from blade end 18. To this end, area 28 may be an area of reduced thickness, such as a notch in the body between the blade end and the handle end, which facilitates the separation of the handle end from the blade end by manual hand manipulation. Instead of a notch, a score line or the like may be provided to render the handle and blade ends separable. Indeed, there may be instances where body 12 may be fabricated in such a way that no area of structural weakness is inherently provided, but that the handle and blade ends may merely be separated by breaking the razor body into two pieces. It is, however, preferred to include an area of structural weakness as area of joinder 28 so that a good, clean break may be achieved by a quick snapping action. Moreover, it is also preferred that razor body 12 be fabricated as a singular structure so that handle end 16, blade end 18 and area of joinder 28 are integrally formed of the same material. Such an integrally formed razor body is consistent with inexpensive manufacture of the razor and, of course, significantly contributes to rendering the razor disposable after one use.

Figure 3:
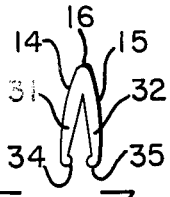
FIG. 3 is an end view of the safety straight razor of FIG. 1 as viewed from the handle end.
Figure 4:
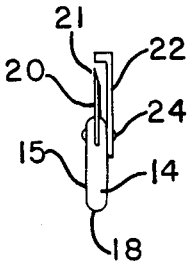
FIG. 4 is an end view of the safety straight razor of FIG. 1 as viewed from the blade end.
Figure 5:
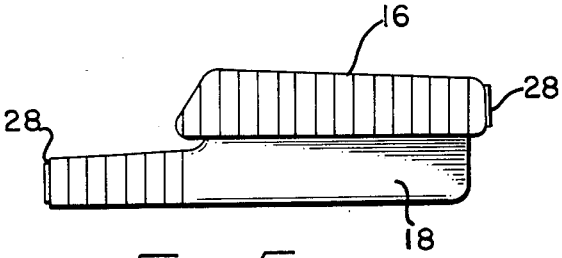
FIG. 5 is a side elevational view of the blade end of the safety straight razor of FIG. 1 illustrating the handle end separated from the razor and covering the blade at the blade end of the razor.
Figure 6:
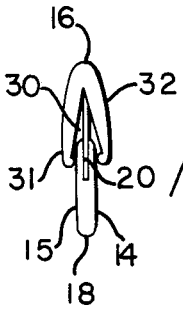
FIG. 6 is an end view of the configuration of FIG. 5 illustrating the handle end serving as blade cover after the razor has been used.

Referring more particularly to FIG. 3, it can be seen that handle end 16 includes a groove 30 positioned between opposed substantially planar surfaces 14 and 15. This groove extends at least along the entire length of handle end 16. Groove 30 is preferably formed within handle end 16 so as to resemble a V-configuration, with planar surfaces 14 and 15 lying on opposed legs of the V-configuration. As a result of the shape of groove 30, and particularly when razor body 12 is fabricated from plastic material, the V-shaped legs 31 and 32 of handle end 16 are resiliently opposed from each other. Such resilience facilitates the ability to position blade 20 into groove 30 when handle 16 serves as the protective cover for the blade after use of the razor. It is also preferred that legs 31 and 32 of handle end 16 include small protuberances 34 and 35 which aid in the gripping of blade end 18 when handle end 16 is positioned over the blade.

After razor 10 has been used for shaving purposes, it is intended that it be disposed after one use. Particularly, since this razor is intended for barber shop or professional use, protection from the exposed edge of blade 20 is desirable during and after the discardal of the razor. To this end, handle end 16 serves a dual role as a gripping member and a cover for the blade after the razor has been used. Handle end 16 is separated from blade end 18 by manual hand manipulation, and then the separated handle end is positioned over the blade protruding from the blade end. It is preferred that separated handle end 16 be slid over the blade end so that blade 20 slides into groove 30. The resiliency of legs 31 and 32 facilitate the positioning of the blade into the groove, while also assuring that handle end 16 remains in its proper position without easily sliding off. Once handle end 16 covers blade 20 over blade end 18, the entire assembly is ready for discardal with the assurance that adequate safety precautions have been taken.

While different materials may be utilized in the fabrication of the present invention, it is preferred that body 12 be made from plastic which is readily moldable into a configuration suitable for a safety straight razor. Materials such as polypropylene, polyethylene, and the like may be utilized. It is preferred that blade 20 be made from metal, such as stainless steel or similar metals commonly used for razor blades.

Thus, the present invention provides a safety straight razor which is not only intended to be disposable, but is most suitable for barber shop and professional use. In addition to being inexpensively manufactured, so that the razor may be disposed after one use, the present razor includes a number of safety features. A removable shield protectively covers the exposed razor blade prior to use of the razor, while the handle end of the razor serves as a protective cover for the exposed razor blade after the razor has been used. The present invention, therefore, requires a minimal number of components in providing an attractive, disposable safety straight razor.

What is claimed is:

1. A straight razor comprising:

an elongate body having a handle end for grasping by a user during use, and a blade end, said blade end including a blade having a sharp edge protruding therefrom for shaving purposes, said handle end including an elongate groove adapted to fit over the blade after the razor has been used, said handle end and said blade end of the body being joined at an area of structural weakness so that said handle end and said blade end are separable whereby the separated handle end serves as a protective cover for the blade by placement of the blade into the groove of the handle end.

2. The razor of claim 1 wherein said blade end is substantially flat and is characterized by two opposed planar surfaces.

3. The razor of claim 2 wherein said blade is positioned with respect to said blade end so that the sharp edge protrudes from only one side thereof.

4. The razor of claim 3 wherein said blade is positioned with respect to said blade end so that it lies substantially parallel to the flat cross-section of said blade end.

5. The razor of claim 4 wherein said blade is positioned in said blade end between said opposed planar surfaces.

6. The razor of claim 5 wherein said blade is embedded in said blade end.

7. The razor of claim 5 wherein said blade is irremovably positioned in said blade end.

8. The razor of claim 1 which further includes a removable shield over the sharp edge of the razor.

9. The razor of claim 8 wherein said shield is removably connected to said body and extends over the protruding sharp edge of the blade.

10. The razor of claim 9 wherein said shield is connected to said body in such fashion so as to be disconnectable by manual hand manipulation.

11. The razor of claim 1 wherein said handle end is substantially flat and is characterized by two opposed planar surfaces.

12. The razor of claim 11 wherein said elongate groove lies between said two planar surfaces.

13. The razor of claim 12 wherein said groove extends into said handle end so a V-configuration is formed, with each of said planar surfaces lying on opposed legs of said V-configuration.

14. The razor of claim 13 wherein said V-shaped legs of the handle end are resiliently opposed from each other to facilitate the positioning of the blade into the groove so that the separated handle end may serves as a protective cover therefor.

15. The razor of claim 1 wherein said area of structural weakness is an area of reduced thickness of said body which facilitates the separation of the handle end from the blade end by manual hand manipulation.

16. The razor of claim 15 wherein said area of reduced thickness is a notch in said body between said blade end and said handle end.

17. The razor of claim 1 wherein said body is a singular structure so that said handle end, said blade end and said area of joinder are integrally formed of the same material.

18. A razor comprising:

a body having a first end and a second end, said body being formed of a singular structure so that said first and said second ends are integrally joined and made of the same material, said first end having a razor blade edge protruding therefrom, said second end adapted to be grasped during use of the razor and being separable from said body, said second end having means for serving as a protective cover for the razor blade edge after the second end is separated from the body.

19. The razor of claim 18 which further comprises removable means for protectively shielding the razor blade edge prior to use of the razor.

20. A safety straight razor comprising:

a substantially flat, elongate body characterized by two opposed planar surfaces and including an integrally formed blade end, a handle end for grasping by a user and an area of joinder of said handle end and said blade end;

a razor blade irremovably positioned in said blade end so that it lies substantially parallel to the flat cross-section of said blade end and so that a sharp edge of the blade protrudes from one side of the blade end for shaving purposes;

a shield removably connected to said body extending over the sharp edge of the blade for protection prior to use of the razor;

said handle end including an elongate groove, between the two planar surfaces, of such size and shape to fit over the protruding razor blade edge; and said area of joinder being characterized by an area of structural weakness so that the handle end is separable from the body by manual hand manipulation whereby the separated handle end serves as a protective cover for the blade edge by placement of the blade edge into the groove of the handle end.

* * * * *